United States Patent [19]

Blumkin et al.

[11] Patent Number: 4,626,816

[45] Date of Patent: Dec. 2, 1986

[54] MULTILAYER SERIES-CONNECTED COIL ASSEMBLY ON A WAFER AND METHOD OF MANUFACTURE

[75] Inventors: Rubin Blumkin, Great Neck, N.Y.; Robert Pereira, Jr., Jacksonville, Fla.

[73] Assignee: American Technical Ceramics Corp., Huntington Station, N.Y.

[21] Appl. No.: 836,634

[22] Filed: Mar. 5, 1986

[51] Int. Cl.[4] ..... H01F 27/28; H01F 41/04

[52] U.S. Cl. ..... 336/192; 29/602 R; 336/200; 336/232

[58] Field of Search ..... 336/200, 232, 223, 192; 29/602 R, 605, 846, 851

[56] References Cited

U.S. PATENT DOCUMENTS 3,798,059 3/1974 Astle et al. ..... 336/200 X 4,313,151 1/1982 Vranken ..... 336/200 X 4,547,961 10/1985 Bokil et al. ..... 29/602 R

OTHER PUBLICATIONS

"Printed Delay Line", Altmann et al., IBM Technical Disclosure Bulletin, vol. 8, No. 5, Oct. 1965, pp. 741–742.

*Primary Examiner*—Thomas J. Kozma

*Attorney, Agent, or Firm*—Edward H. Loveman

[57] ABSTRACT

A coil assembly has flat spiral conductive coils on an insulative slab. The coils are respectively covered by alternate insulative layers having open areas exposing inner ends of the coils to which conductive jumpers are connected. Outer ends of the coils are connected to other conductive pads on the slab. The coils are connected in series via the jumpers.

16 Claims, 20 Drawing Figures

MULTILAYER SERIES-CONNECTED COIL ASSEMBLY ON A WAFER AND METHOD OF MANUFACTURE

BACKGROUND OF THE INVENTION

1. Field of the Invention.

This invention relates to the art of miniature inductors, and more particularly concerns an inductor assembly in which a plurality of flat spiral series-connected inductors are superimposed on a wafer.

2. Description of the Prior Art.

It is known in the prior art such as described in U.S. Pat. No. 4,322,698 to provide a chip-shaped laminated electronic part including at least one inductor. The assembly comprises a plurality of sheets of an insulating material, and electrically conductive patterns are formed on the surface of each sheet. The patterns are connected to form one or more coils to provide at least one inductor. The assembly is monolithic.

SUMMARY OF THE INVENTION

The present invention is directed at providing a miniature inductor assembly having a plurality of series-connected coils on a single dielectric substrate, such as a thin ceramic wafer. According to the invention a conductive pad and a first flat spiral coil are printed or otherwise applied to a flat dielectric wafer. Then a glass layer is imposed on the wafer covering the coil, with a portion of the glass layer open to expose an inner end of the coil. The outer end of the coil is connected to the conductive pad. A flat conductive jumper is applied over the glass layer with one end contacting the inner end of the coil. A thin, glass strip is then applied over the jumper leaving only a small end portion exposed. Another flat spiral coil and a strip with its outer end in contact with the exposed end of the jumper, is applied on the glass layer. A second glass layer is imposed on the second coil with an open area exposing the inner end of the second coil. A second flat jumper is applied on the second glass layer with one end of the jumper in contact with the inner end of the second coil. The resulting unit is a monolithic, multilayered inductor assembly having two coils connected in series aiding relationship. The method can be repeated and contined to provide as many coils as desired all interconnected in a unitary multilayered assembly.

These and other objects and many of the attendant advantages of this invention will be readily appreciated as the same becomes better understood by reference to the following detailed description when considered in connection with the accompanying drawings in which:

DESCRIPTION OF THE PREFERRED EMBODIMENTS

Figure 1:
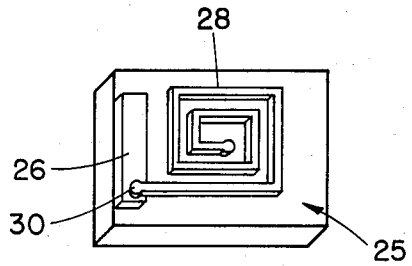
FIG. 1 through FIG. 7 show oblique top views of an inductor assembly embodying the invention having two series-connected coils, shown at successive steps in a preferred method of manufacture according to the invention.
Figure 8:
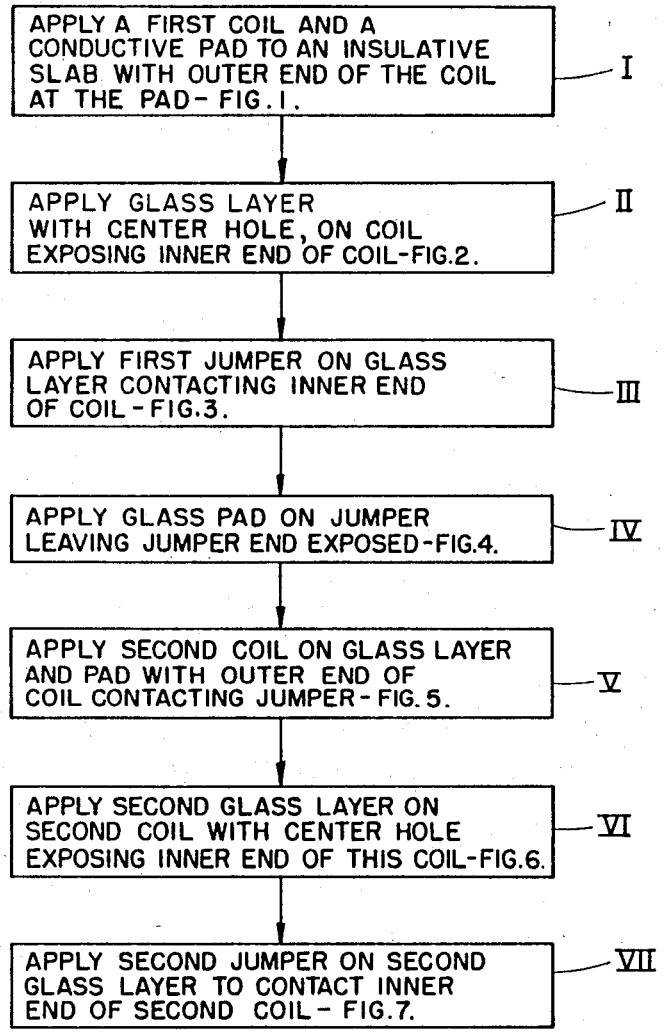
FIG. 8 is a flow chart summarizing principal successive steps or stages in a method or process of manufacturing the inductor assembly according to the invention.

Referring now to the drawings wherein like reference characters designate like or corresponding parts throughout, there is illustrated in FIG. 1 and described at step I in the flow chart of FIG. 8, a thin, flat, rectangular, dielectric insulative slab or wafer, generally designated as reference numeral 25 which may be made of a suitable glass or ceramic material. On the slab 25 is applied a flat rectangular conductive pad 26, which may be made of a conventional silver paste. Adjacent to the pad 26 there is applied a first, flat, rectangular, circular, or other appropriately shaped conductive spiral coil 28, which may also be made of a silver paste. The outer end 30 of the coil 28 contacts the pad 26. The slab 25 may, at this point, if desired, be fired to set the material of the pad 26 and the coil 28.

Figure 2:
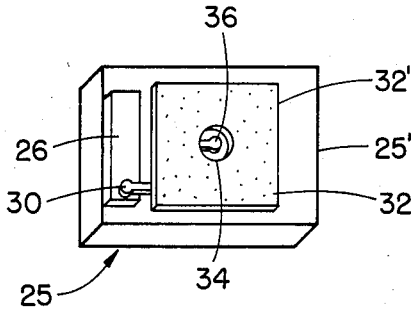

In step II of FIG. 8 and as shown in FIG. 2, a thin insulative glass layer 32 is applied over the coil 28 on the slab 25. This layer 32 may be made of powdered glass applied by a conventional screening process, and may be fired, if desired. It will be noted that a clear, open, area 34 is provided in the layer 32 to expose an inner end 36 of the coil 28. An edge 32' of the layer 32 is spaced slightly from a right edge 25' of the slab 25.

Figure 3:
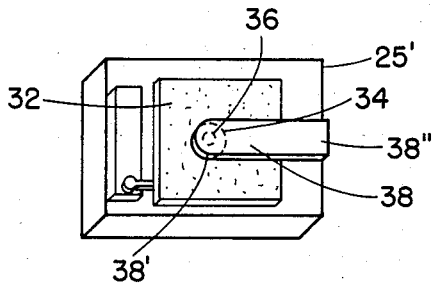

In step III of FIG. 8 and as shown in FIG. 3, a flat, conductive jumper or strip 38 is applied transversely across part of the layer 32. An inner end 38' of the strip 38 is in contact with the inner end 36 of the coil 28 at the opening 34 in the layer 32. The outer end 38'' of the strip 38 extends to the outer or right edge 25' of the slab 25. The strip 38 serves as a conductive jumper for the assembly.

Figure 4:
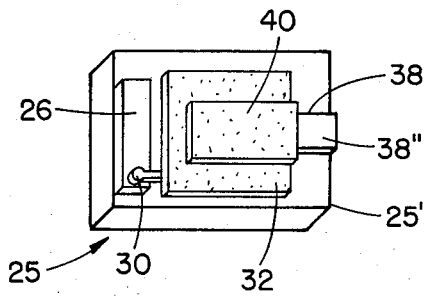

In step IV of FIG. 8, and as shown in FIG. 4, a flat, thin, insulative, glass strip or pad 40 is applied over the glass layer 32 and over most of the jumper or strip 38 leaving the right end portion 38'' of the jumper strip 38 exposed.

Figure 5:
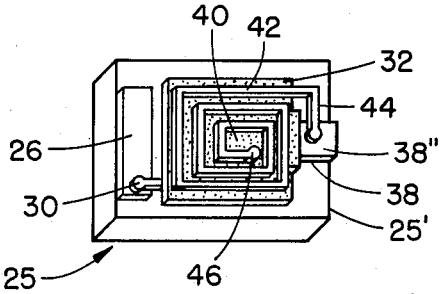

In step V of FIG. 8 and as shown in FIG. 5, a second conductive, flat spiral coil 42 is applied on the insulative layer 32 and over the insulative strip or pad 40. An outer end 44 of the coil 42 is applied on and contacts an outer end 38'' of the jumper 38. The outer end portion 38'' may be wholly contained within the edges of the slab 25 or as shown, may extend outward of the edge 25'. These options will be more clearly described below.

Figure 6:
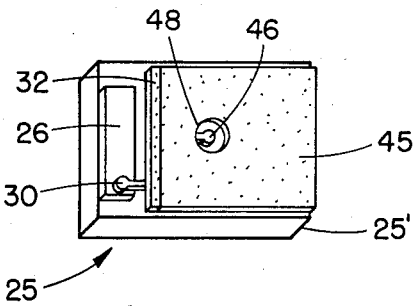

In step VI of FIG. 8 and as shown in FIG. 6, a second insulative glass layer 45 is applied over the second coil 42 covering the entire coil except for the inner end 46 which is exposed at an open, area 48 of the layer 45.

Figure 7:
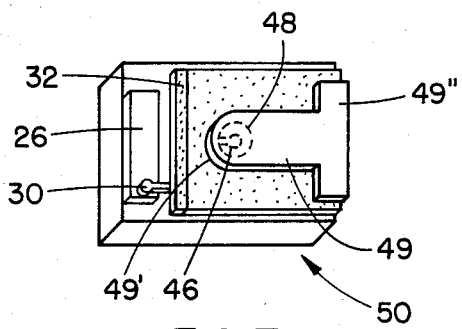

In step VII of FIG. 8 and as shown in FIG. 7, a second jumper 49 in the form of a flat conductive strip of silver paste or the equivalent, is applied on the insulative glass layer 45. The inner end 49' of the jumper 49 overlays and contacts the inner end 46 of the coil 42. The outer end 49'' of the jumper overlays the right edge 25' of the slab 25 and serves as a pad for a circuit terminal connection. Step VII completes the multilayered inductor assembly 50.

Figure 9:
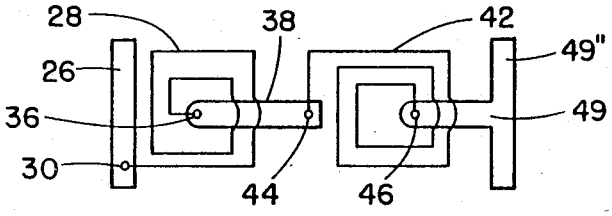
FIG. 9 is a schematic representation of an equivalent circuit diagram of the completed inductor assembly shown in FIG. 7.

FIG. 9 shows an equivalent circuit diagram of the assembly 50. The outer end 30 of coil 28 contacts the pad 26. The inner end 36 of the coil 28 is electrically connected to the outer end 44 of the coil 42 via the jumper 38. The inner end 46 of the coil 42 is connected to the jumper 49. The diagram of FIG. 9 shows that the two coils 28 and 42 are connected in series aiding relationship (inductances added). At the outer ends of the inductor assembly 50 are the conductive pads 26 and 49'' to which teminals of an external circuit can easily be connected. The two pads 29 and 49'' are widely separated physically to insure electrical separation of opposite ends of the assembly of coils.

If desired, opposite ends 25' and 25'' may be provided with terminations, by conventionally plating the ends with an electrically conductive coating, such as silver paladium, so that the assembly 50 may be mounted on one end in a circuit on a printed circuit board, with the other end connected to a circuit on the board. In this configuration it is essential that the outer end 38'' of the jumper 38 be contained within the edge 25' of the slab 25, so that the glass layer 45 will insulate the jumper end 38'' from the termination coating hereinabove described.

At various steps or stages in the process the laminated assembly can be fired or otherwise treated to set the insulative and/or conductive materials applied. The entire assembly employs a single dielectric slab or wafer, so that the resulting assembly is a miniature chip for use in miniature circuits. Although the assembly 50 has heretofore been described for use in connection with two coils connected in series aiding relationship, if the end portion 38'' of the jumper 38 extends outward of the right edge 25' of the slab 25, the assembly 50 may be used as a tapped coil or auto-transformer by merely connecting terminals to the jumper 26, 49, and 38''.

FIGS. 10-20 illustrate how the principles of the invention can be applied to make an assembly of three series connected coils employing a single dielectric slab or wafer.

Figure 10:
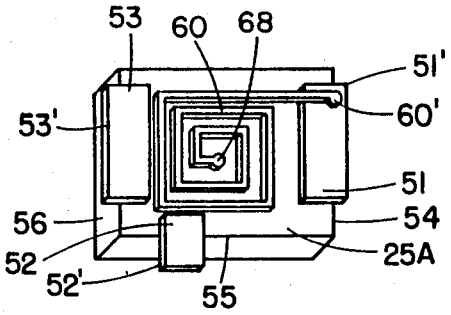
FIGS. 10 through 18 are oblique top views of another inductor assembly having three interconnected coils embodying another form of the invention, and shown at successive steps or stages in a process of manufacturing the assembly.
Figure 19:
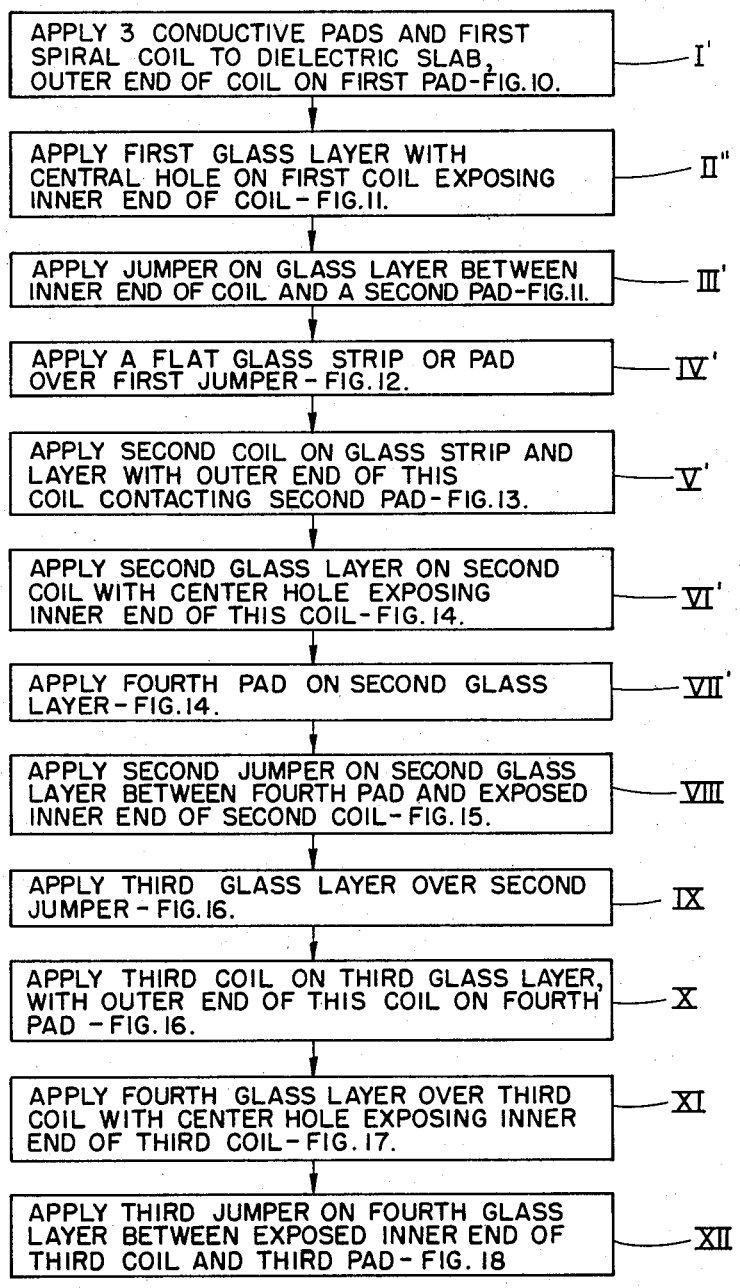
FIG. 19 is a flow chart similar to FIG. 8 summarizing principal successive steps or stages in manufacturing the assembly of FIGS. 10–18.

In step I' as described in FIG. 19 and shown in FIG. 10, three electrically conductive pads 51, 52, and 53 are applied to a flat, insulative slab or wafer 25A. The pads 51, 52, and 53 may be wholly contained within the edges of the wafer 25A. Alternatively, as shown, each pad 51, 52 and 53 may have a respective conductive tab 51', 52' and 53' extending outwardly beyond respective adjacent edges 54, 55, and 56 of the slab 25A. The tabs 51', 52', and 53', will facilitate connection of terminals of an external circuit or circuits. Each of the pads may be made of silver paste and set by firing. Then a thin metal leaf may be applied over the pad to form a tab extending outside of the wafer. Alternatively, each pad and tab may be formed as a unit by a single metal leaf cemented or otherwise applied to the wafer 25A.

A first, flat, spiral conductive coil 60 is applied to the upper side of the wafer 25A on which are the first, second, and third spaced pads 51–53. An outer end 60' of the coil 60 is connected to the first pad 51 adjacent to the right edge 54 of the wafer 25A as shown in FIG. 10, and may follow application of the pads to the wafer.

Figure 11:
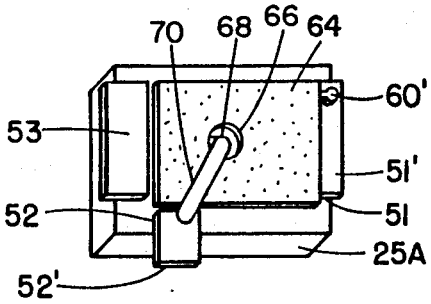

In step II' of FIG. 19 and FIG. 11 a first insulative glass layer 64 is applied over the coil 60. The layer 64 is clear of the pads 51–53 and an open area 66 exposes an inner end 68 of the coil 60.

In step III' of FIG. 19 and as shown in FIG. 11, a first conductive jumper 70 is applied on the insulative layer 64 and it is connected between the inner end 68 of the coil 60 and the pad 52.

Figure 12:
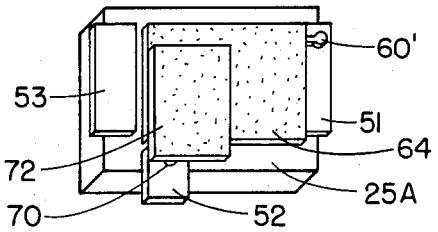

In step IV' of FIG. 19 and as shown in FIG. 12 a flat glass strip or pad 72 has been applied over the jumper 70 on the insulative layer 64.

Figure 13:
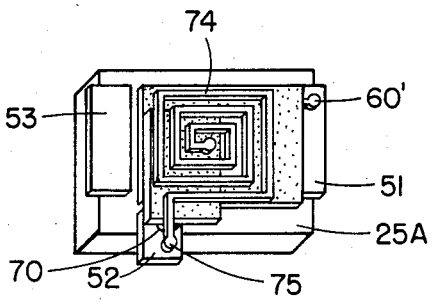

In step V' of FIG. 19, and as shown in FIG. 13, a second flat spiral conductive coil 74 has been applied over the insulative layer 64 and the pad 72. The outer end 75 of the coil 74 contacts the pad 52 adjacent to the end of the jumper 70.

Figure 14:
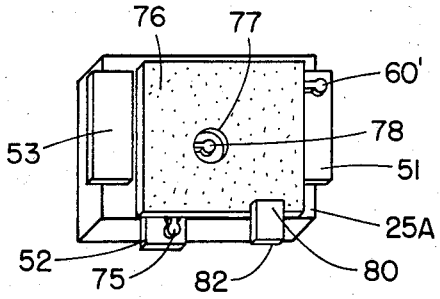

In step VI' of FIG. 19, and as shown in FIG. 14, a second insulative glass layer 76 is applied on the layer 64 and the pad 72 to cover the coil 74. An open area 77 in the layer 76 exposes an inner end 78 of the coil 74.

In step VII' of FIG. 19, and as shown in FIG. 14 a fourth conductive pad 80 has been applied on the insulative layer 76 spaced from the pad 52. The pad 80 has a tab 82 extending beyond the adjacent edge of the wafer 25A.

Figure 15:
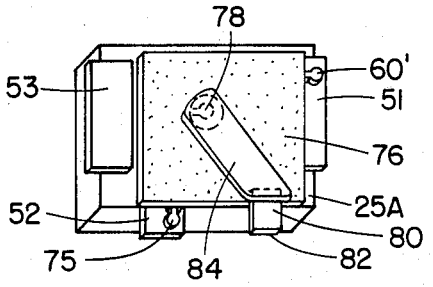

In step VIII of FIG. 19, as shown in FIG. 15, a second flat conductive jumper 84 has been applied on the insulative layer 76. The inner end of the jumper 84 overlays and contacts the inner end 78 of the coil 74. The outer end of the jumper 84 contacts the conductive pad 80.

Figure 16:
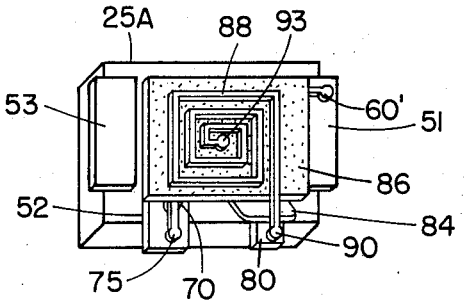

In step IX of FIG. 19, as shown in FIG. 16, a third insulative glass layer 86 has been applied over the layer 76 and the jumper 84.

In step X of FIG. 19, and as shown in FIG. 16, a third flat, spiral conductive coil 88 has been applied over the insulative layer 86. An outer end 90 of the coil 88 contacts the pad 80.

Figure 17:
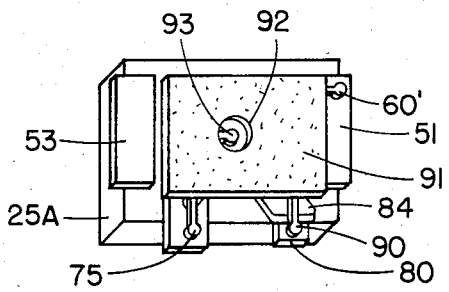

In step XI of FIG. 19, and as shown in FIG. 17, a fourth insulative glass layer 91 has been applied over the insulative layer 86 and covers the coil 88. An open area 92 in the layer 91 exposes the inner end 93 of the coil 88.

Figure 18:
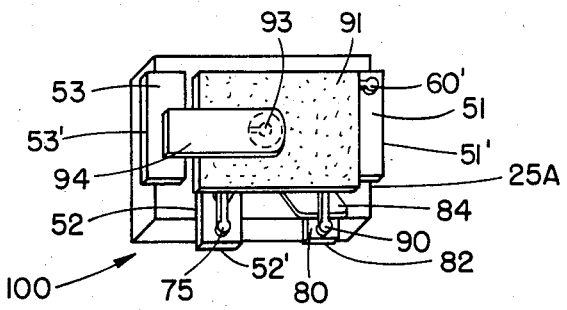

In step XII of FIG. 19 and as shown in FIG. 18, a third jumper 94 has been applied over the insulative layer 91 transversely of the wafer 25A. The inner end of the jumper 94 overlays and contacts the inner end 93 of the coil 88. The outer end of the jumper 94 overlays and contacts the conductive pad 53. FIG. 18 shows the completed laminated inductor assembly 100.

Figure 20:
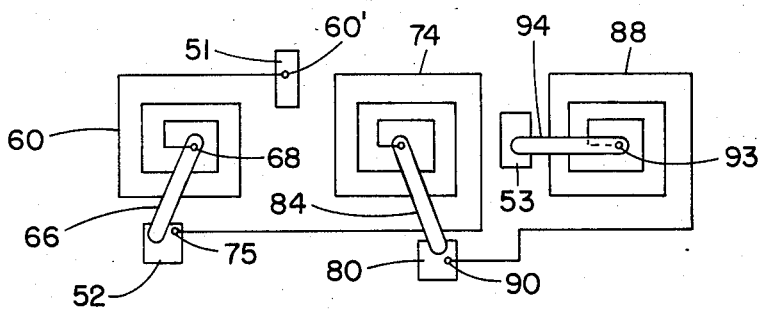
FIG. 20 is a schematic representation of an equivalent circuit diagram of the completed assembly shown in FIG. 18.

FIG. 20 shows the equivalent electrical circuit of the inductor assembly 100. The outer end 60' of the first coil 60 contacts the pad 51. The inner end 68 of the coil 60 contacts the jumper 66. The outer end of the jumper 66 contacts the pad 52. The outer end 75 of the coil 74 also contacts the pad 52. The inner end of the second coil 74 contacts the second jumper 84 which contacts the pad 80. The outer end 90 of the third coil 88 also contacts the pad 80. The third jumper 94 contacts the inner end 93 of the coil 88 and connects it electrically to the pad 53. By this arrangement, there is provided an assembly of three conductive coils connected in series and disposed in a laminated array on the single wafer or slab 25A.

It will be understood that at various steps or stages of the process the assembly can be fired by conventional means to set the insulative layers and pads and/or conductive pads, jumpers and coils. The resulting assemblies 50 and 100 of FIGS. 7 and 18 are compact chips especially adapted to connection with one or more miniature circuits. The external tabs, 51', 52', 53' and 82 make it possible to tap into the coil assembly at any desired point, so that the assembly may be used as a tapped coil or auto-transformer.

Although the invention has been described as using silk screening processing it is obvious that conventional thin film techniques as well as other thick film techniques may be utilized.

It should be understood that the foregoing relates to only a limited number of preferred embodiments of the invention which has been by way of example only and that it is intended to cover all changes and modifications of the example of the invention herein chosen for the purpose of the disclosure, which do not constitute departures from the spirit and scope of the invention.

What is claimed:

1. A coil assembly, comprising:

a flat, electrically insulative slab having free edges;

a conductive pad on said slab adjacent one of said edges of said slab;

a first, flat, spiral, conductive coil on said slab; said coil having inner and outer ends, said outer end of said coil being connected to said pad;

a first, thin, flat insulative layer on said slab covering said coil, said layer having an open area exposing said inner end of said coil;

a first, flat, conductive jumper on said slab and said layer, said jumper being connected at one end thereof to said inner end of said coil, said jumper having an outer end disposed near another edge of said slab;

an insulative pad on said jumper;

a second, flat, spiral, conductive coil on said first insulative layer having inner and outer ends, said outer end of said second coil being connected to said outer end of said jumper;

a second, thin, flat insulative layer on said first insulative layer and said insulative pad, covering said second coil and said outer end of said jumper, said second insulative layer having another open area exposing said inner end of said second coil; and a second flat conductive jumper on said second insulative layer connected at one end thereof to said inner end of said second coil, so that said first and second coils are electrically connected together in series between said conductive pad and said second jumper.

2. A coil assembly as defined in claim 1, wherein said other end of said second jumper is disposed near an edge of said slab to constitute a second conductive pad thereon, said first named pad and said second conductive pad being spaced apart and exposed on said slab for connection thereto of an external circuit.

3. A coil assembly as defined in claim 1, further comprising a second conductive pad on said slab spaced from said first named pad, said first jumper being connected to said second pad.

4. A coil assembly as defined in claim 1 further comprising a second conductive pad spaced from said first named pad, said second jumper being connected to said second pad.

5. A coil assembly as defined in claim 1, wherein opposite edges of said slab are plated with an electrically conductive coating.

6. A coil assembly as defined in claim 1 wherein said first pad, said outer end of said first jumper and the other end of said second jumper have laterally extending tabs to facilitate connecting thereto in a tapped coil or autotransformer configuration.

7. A coil assembly as defined in claim 4, wherein said first and second pads have laterally extending tabs to facilitate connecting external circuit terminals thereto.

8. A coil assembly as defined in claim 4, further comprising:

a third, thin flat insulative layer on said second insulative layer and said second jumper;

a third, flat, spiral conductive coil on said third insulative layer having inner and outer ends, and having a further open area exposing said inner end of said third coil;

a third conductive pad on said slab spaced from said first and second pads, said outer end of said third coil being connected to said third conductive pad; and a third jumper on said third insulative layer connected to said inner end of said third coil, said that said first, second and third coils are connected together electrically in series between said first conductive pad and said third jumper.

9. A coil assembly as defined in claim 8, further comprising a fourth conductive pad on said slab, said third jumper being connected to said fourth conductive pad, so that any selected ones of said coils may be connected to an external circuit, by connecting selected ones of said pads to terminals of said circuit.

10. A coil assembly as defined in claim 9, wherein selected ones of said pads have laterally extending tabs to facilitate connecting said terminals of said external circuit thereto.

11. A method of making an assembly of series-connected inductance coils, comprising the steps of:

applying a first flat, spiral, conductive coil and a conductive pad to an insulative slab with the outer end of the coil contacting the pad;

applying a first insulative layer on the slab to cover the coil, with an open area in the layer exposing the inner end of the coil;

applying a first flat, conductive jumper on said layer so that one end of said jumper contacts said inner end of said coil;

applying an insulative pad on said jumper;

applying a second flat, spiral, conductive coil on said insulative layer and said insulative pad, with an outer end of said second coil contacting said other end of said jumper;

applying a second insulative layer on said second coil to cover the same, with an open area in said second layer exposing an inner end of said second coil; and applying a second flat, conductive jumper on said second insulative layer so that one end of said second jumper contacts said inner end of said second coil.

12. A method as defined in claim 11, comprising the further steps of selectively firing said slab, said insulative pad, said insulative layers, said conductive pad, coils and jumpers, to set and stabilize the same.

13. A method as defined in claim 11, comprising the further steps of:

applying a second conductive pad on said slab so that the other end of said said second jumper contacts said second conductive pad applying a third insulative layer on said second insulative layer and said second jumper;

applying a third flat, spiral conductive coil on said third insulative layer;

applying a fourth insulative layer on third coil with a further open area in said fourth layer exposing an inner end of said third coil; and applying a third flat conductive jumper on said fourth insulative layer so that one end of said third jumper contacts said inner end of said third coil, whereby all three coils are connected electrically in series between said first named conductive pad and said third jumper.

14. A method as defined in claim 13, comprising the further steps of applying other spaced conductive pads on said slab and respectively connecting said other pads to outer ends of said first, second, and third jumpers.

15. A method as defined in claim 14, comprising the further steps of selectively firing said slab, conductive pads, jumpers and coils, insulative layers, and insulative pad to set and stabilize the same.

16. A method as defined in claim 14, comprising the further steps of providing tabs on selected one of said pads extending laterally outwardly from edges of said slab to facilitate connecting terminals of an external circuit thereto.

* * * * *